US005302001A

United States Patent [19]

van Dis

[11] Patent Number: 5,302,001

[45] Date of Patent: Apr. 12, 1994

[54] GARDEN FURNITURE CUSHIONS WITH EXCHANGEABLE COVER

[75] Inventor: Willem van Dis, Fijnaart, Netherlands

[73] Assignee: Q. C. International B. V., Bosschenhoofd, Netherlands

[21] Appl. No.: 951,304

[22] Filed: Sep. 21, 1992

Related U.S. Application Data

[63] Continuation of Ser. No. 609,160, Nov. 2, 1990, abandoned.

[30] Foreign Application Priority Data

| | | | |
|---|---|---|---|
| Nov. 3, 1989 | [NL] | Netherlands | 89.02723 |
| Dec. 22, 1989 | [NL] | Netherlands | 89.03149 |
| Aug. 30, 1990 | [NL] | Netherlands | 90.01917 |

[51] Int. Cl.[5] ..... A47C 31/02

[52] U.S. Cl. ..... 297/228.13; 5/409; 5/471; 5/472; 297/219.1; 297/452.6; 297/DIG. 6

[58] Field of Search ..... 297/218, 219, DIG. 6; 24/107, 618, 623, 662, 903; 5/408–410, 470–472, 923

[56] References Cited

U.S. PATENT DOCUMENTS

| | | | |
|---|---|---|---|
| 659,251 | 10/1900 | Nerad | 297/218 |
| 1,524,637 | 1/1925 | Carr | 24/623 |
| 1,951,843 | 3/1934 | Rosberger et al. | 5/472 X |
| 2,756,443 | 7/1956 | Gitlin | 5/472 |
| 2,845,637 | 8/1958 | Di Stefano | 5/472 X |
| 2,901,028 | 8/1959 | Bottemiller | 5/408 |
| 2,988,760 | 6/1961 | Sarbach | 5/471 |
| 3,103,082 | 9/1963 | Baermann | 5/472 |
| 3,308,490 | 3/1967 | Cacioppo | 5/923 X |
| 3,408,105 | 10/1968 | Portell | 297/219 |
| 4,037,296 | 7/1977 | White et al. | 5/472 X |
| 4,044,412 | 8/1977 | Barron | 5/356 |
| 4,792,111 | 12/1988 | Taguchi | 297/DIG. 6 X |
| 4,864,669 | 9/1989 | Jones | 5/923 X |
| 5,007,676 | 4/1991 | Lieu | 297/DIG. 6 X |

FOREIGN PATENT DOCUMENTS

| | | | |
|---|---|---|---|
| 486612 | 7/1976 | Australia . | |
| 165149 | 6/1949 | Austria | 5/472 |
| 3321410 | 12/1984 | Fed. Rep. of Germany | 297/219 |
| 8608997 | 8/1986 | Fed. Rep. of Germany . | |
| 1320876 | 2/1963 | France . | |
| 2556199 | 6/1985 | France . | |

*Primary Examiner*—Peter R. Brown
*Attorney, Agent, or Firm*—Christensen, O'Connor, Johnson & Kindness

[57] ABSTRACT

A cushion for use on garden furniture is provided, which cushion comprises a filling and a removable cover. To avoid folds developing in the cover, prevent the cover from hanging loosely thereon and to enhance its general appearance, the cover is on its inside and the filling is on its outside provided with releasable mutually fitting connections. These connections can be press studs, VELCRO tape, or a snap connection. Thus the removable cover is kept in its position relative to the filling. According to a preferred embodiment, the connections fitted on the filling are plates comprising a hole attached to the filling, and the connections attached to the cover are plates or buttons comprising a mushroom-like extension, fitting in the holes, together forming a snap connection.

2 Claims, 4 Drawing Sheets

GARDEN FURNITURE CUSHIONS WITH EXCHANGEABLE COVER

This application is a continuation application based on prior copending application Ser. No. 07/609,160, filed on Nov. 2, 1990 now abandoned.

BACKGROUND OF THE INVENTION

The present invention relates to a cushion for use on an item of garden furniture comprising at least one filling, and a cover provided with at least one opening and enclosing the cushion on both sides. Such cushions are generally known.

Such an exchangeable cover is generally used to facilitate cleaning of the cushion. Cleaning the whole cushion in the washing machine when it has become soiled is indeed a general problem. This often results in a volume reduction and change of shape of the filling so that in the washed state the cushion no longer has an attractive appearance. A cushion will often not fit into a normal domestic washing machine.

The above problem is solved through the use of an exchangeable cover, since cleaning can then be easily performed by removing the cover and cleaning it separately, for instance in a washing machine.

Another advantage of these known cushions with an exchangeable cover is that, should taste, trend or fashion change, a new cover can easily be fitted so that the user could have adapted cushions at a cost considerably smaller than the purchase of completely new cushions would involve. A further advantage of these cushions provided with an exchangeable cover is the fact that the volume of a retail trader's stock could be considerably reduced by having a limited number of fillings in stock in combination with a large number of diversely designed cushions. A wide choice of cushions can hereby be offered to a potential purchaser by the retail trader, while the trader does not need to stock a large volume of complete cushions.

Despite all the above mentioned advantages, cushions provided with exchangeable covers have the drawback that the cover will begin to hang loosely and develop folds, certainly at the bottom of the back cushion. Such a cushion does not have an attractive appearance.

SUMMARY OF THE INVENTION

The present invention has for its object to provide such a cushion wherein an improved appearance is obtained and wherein the danger of undesired folding is considerably reduced.

This purpose is achieved in that the cover is provided on its inside and the filling on its outside with releasable connections fitting onto each other.

Due to these steps it is possible to attach the cover at diverse points on its surface to the filling so that the danger of folding is avoided and the cushion including the filling obtains an attractive appearance.

A further advantage is that the filling is well fixed in the cover and remains in place.

As result it also becomes easier to use cushions with an exchangeable cover so that the advantages thereof can be better utilized.

BRIEF DESCRIPTION OF THE DRAWINGS

The present invention will now be elucidated with reference to the drawings, wherein.

Figure 1:
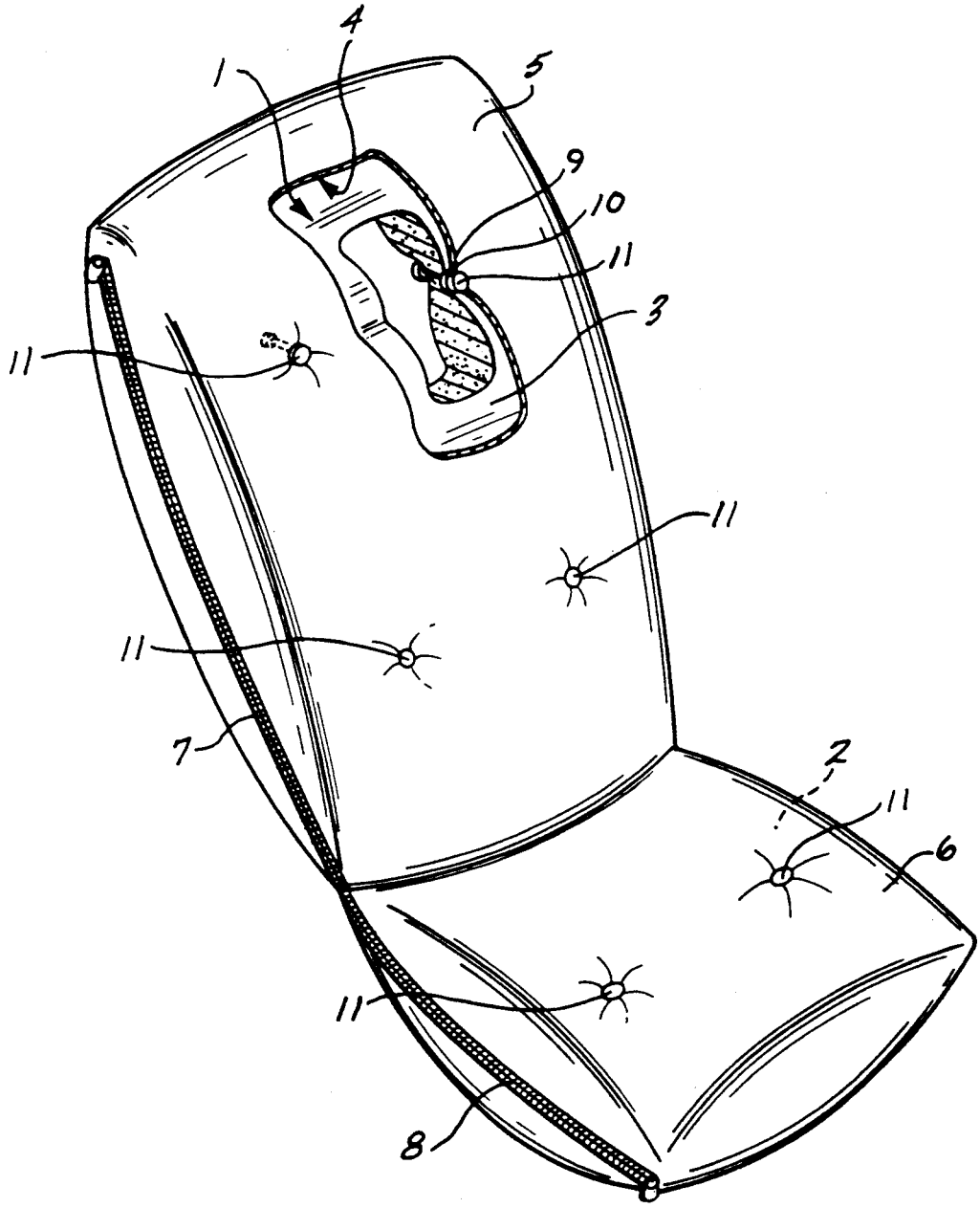
FIG. 1 shows a partly broken away perspective view of a first embodiment of a cushion according to the present invention.

The cushion shown in FIG. 1 is formed by a filling 1 and a cover 4. Arranged around the back filling 3 as shown in the drawing is a back cover 5. The covers 4, 5 are joined to one another. Arranged in the side of each of the covers 4, 5 is a zip closure 7 and 8 respectively so that the covers can be opened for removal of the filling.

In order to improve the appearance of the cushion and to prevent folds in the relevant cushions, the filling is provided with a number of press-studs 9. The cover, designed in its entirety by 4, is provided in corresponding positions on the inside with associated negative press-studs 10. Using these press-studs arranged both at the front and rear a good attachment of the cover on the filling is obtained. The cushion also remains properly in place as a result.

Instead of press-studs 9, 10 it is also possible to employ other fixing means such as small pieces of VELCRO tape or the like.

Owing to the flexibility of the cover 4 with respect to the cushion it is further possible to form so much space between the cover and filling that it is easily possible to reach the relevant press-studs with the hand through the opened zip closure to fasten or release them. A similar consideration applies for the press-studs 9, 10 arranged in the seat cushion. For decorative purposes it is possible to arrange a decorative button 11 on the outside of the cover at the location of the press-studs.

According to a preferred embodiment the press-studs placed on either side of a filling are connected to each other so that the filling gives an "upholstered" effect. Through the steps according to the invention this effect is likewise created with a cushion having a loose, exchangeable cover.

Figure 2:
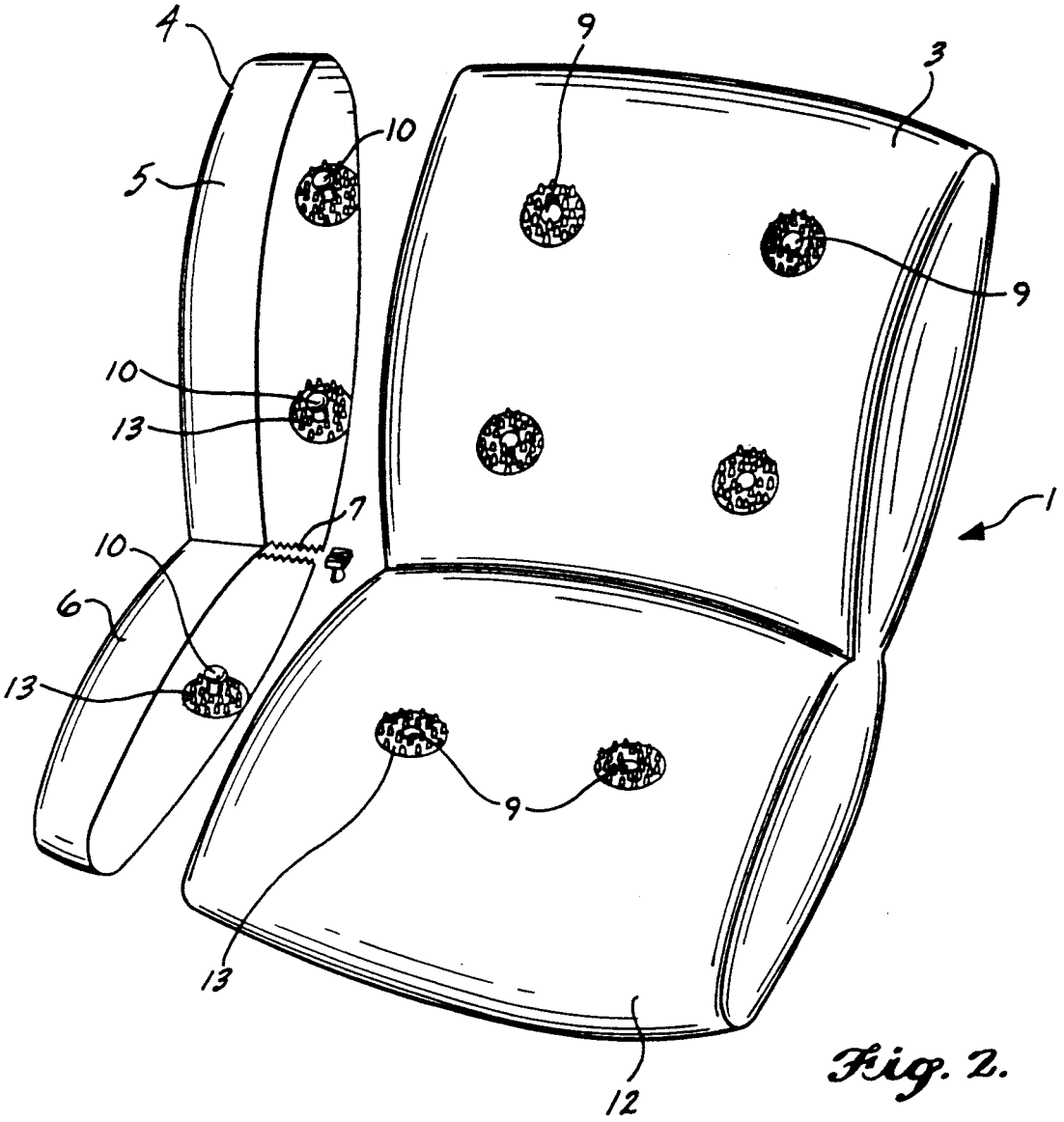
FIG. 2 shows a partly broken away perspective view of a second embodiment of a cushion according to the present invention.

The embodiment depicted in FIG. 2 differs from the embodiment of FIG. 1 in the fact that the press-studs 9, 10 are each combined with a piece of hook and loop fasteners, such as Velcro TM tape or adhesive material therefor. A better fixing is hereby achieved.

Figure 3:
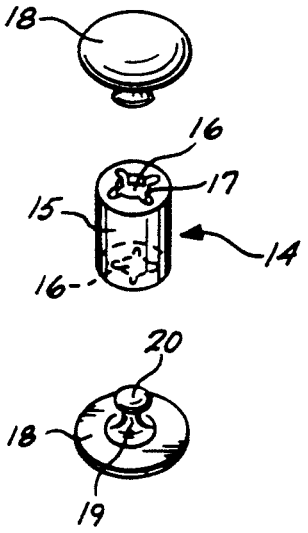
FIG. 3 shows a detail view of a connecting member according to a third embodiment of a cushion according to the present invention.

FIG. 3 shows a third embodiment of the connecting member in more detail.

The connecting member 14 according to this embodiment comprises a sleeve 15, which in general is manufactured from plastic and which is arranged in an opening arranged in the filling 5, 12. The sleeve 15 can otherwise be fixed in the opening arranged in the filling 5, 12 by means of, for example, glue.

The sleeve 15 is hollow and provided on both head ends with an opening 16. The edges of the opening 16 are each provided with a number of teeth 17, in this embodiment four.

In the present embodiment the connecting members that are arranged on the fabric are further embodied as discs 18 which are each provided with a protruding portion 19 having a thickened portion 20 arranged thereon. The discs 18 are connected to the fabric of the cover for instance with a stitch connection or with adhesive. When the cover is fitted round the filling the protrusions 19 with the thickened portions arranged thereon are pushed into the opening 16, wherein the thickened portion 20 slides past the teeth 17 and, having passed the teeth 17, is fixed thereby.

It is however also possible to embody the connecting members as separate studs and to connect these through openings arranged in the cover to the connecting members arranged on the filling.

Figure 4:
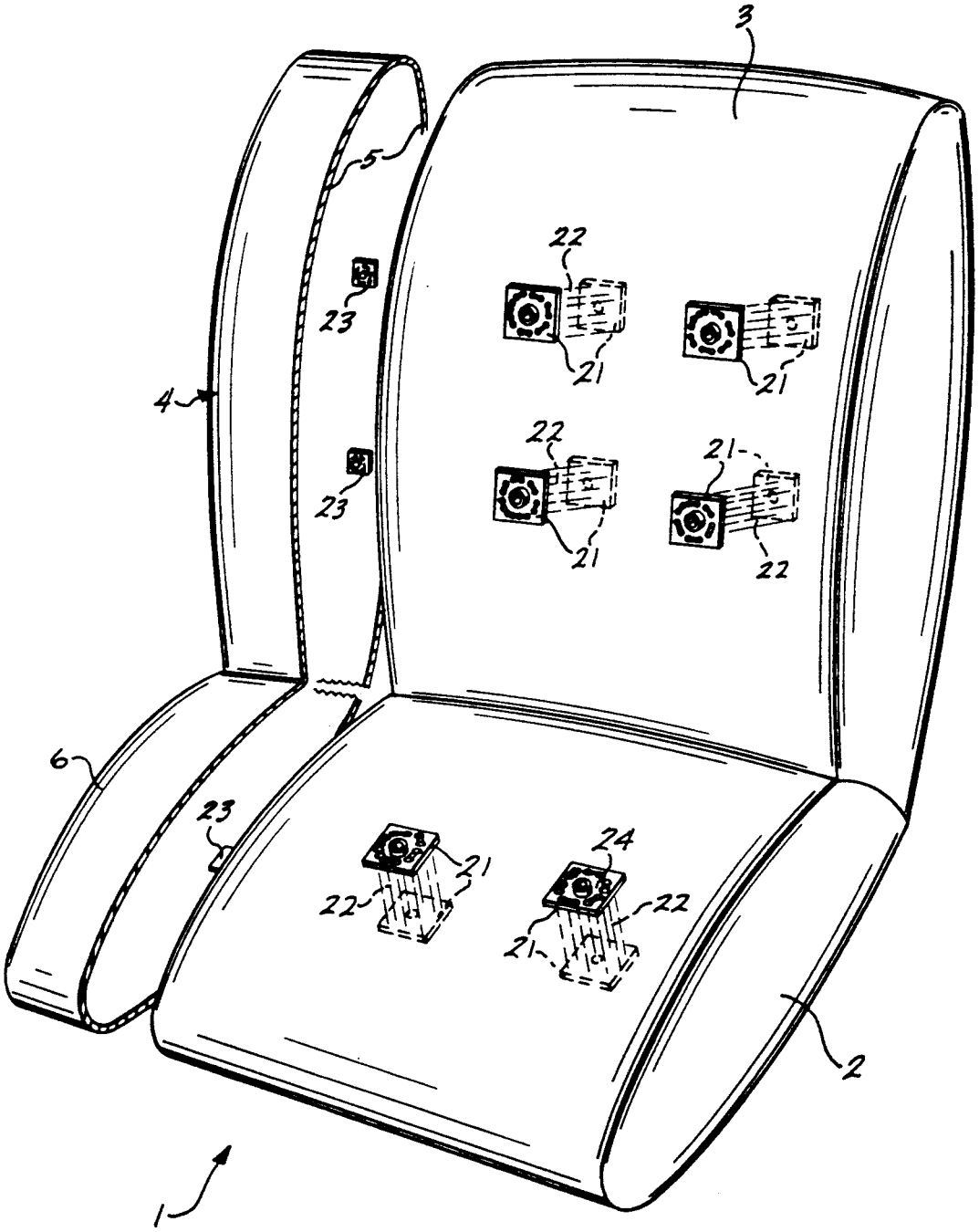
FIG. 4 shows a partly broken away perspective view of a fourth embodiment according to the present invention.

The filling 1 shown in FIG. 4 is formed by a back portion 2 and a seat portion 3. Four filling fixing plates 21 are arranged on the front side of the back portion 2. Four filling fixing plates 21 are likewise arranged on the rear side of the back portion 2, these at corresponding positions. All filling fixing plates 21 are provided with sixteen holes 24 disposed in a circle. All four pairs of oppositely located filling fixing plates 21 are mutually joined by means of stitched seams 22.

Two filling fixing plates 21 are arranged against both the upper part and the lower part of the seat portion 3. The two pairs of fixing plates are here also arranged in corresponding positions and mutually joined by means of stitched seams 22.

In the case of this cushion, which is suitable for a seat with a high back, the distance in sideways direction between adjacently positioned filling fixing plates amounts to 20 cm, while all filling fixing plates are fixed at a distance of 19.5 cm from the closest side edge. The distance between both filling fixing plates on the seat portion and the front edge of the seat portion amounts to 27.5 cm and between these filling fixing plates and the centre seam 26.5 cm, while the distance between the centre seam and the lower pair of filling fixing plates of the back cushion amounts to 29 cm, and the distance between both horizontal pairs of filling fixing plates on the back cushion is 28 cm, as is the distance between the upper filling fixing plates and the top edge.

In the case of a seat cushion with a low back these measurements are similar, except that only one pair of fixing plates is arranged against a side of the back cushion and is located at a distance of 29.5 cm from the centre seam and from the top edge.

The dimensions of a single, so-called tabouret cushion correspond with those of the back portion of a cushion with a low back.

In the case of a cushion for a bed-seat, four filling fixing plates 21 are arranged against each side of the back portion of the filling, wherein the distance between the filling fixing plates and the side wall always amounts to 23 cm, and the distance between the two upper filling fixing plates and the top edge is 29 cm, as it is between the upper and the lower pair of filling fixing plates, while the distance between the lower pair of filling fixing plates and the centre seam amounts to 29 cm. On the seat portion the distance between the two rows of filling fixing plates amounts to 26 cm, as in the case of the back portion, while both rows of filling fixing plates are each 23 cm removed from the closest edge. The distance between the row of filling fixing plates situated closest to the centre seam and the centre seam is 34 cm, as it is between the row of filling fixing plates situated closest to the bottom seam and this bottom seam. The central row of filling fixing plates is 33 cm removed moved from the two neighbouring rows of studs.

The invention further comprises a cover 4. The cover 4 is formed by a back portion 5 and a seat portion 6. As shown in FIG. 4, plates 23 provided with a mushroom-shaped protrusion are arranged against the inside of the back portion 5 and against the inside of the seat portion 6. When the cover 4 is arranged around the filling 1 the mushroom-shaped protrusions are snapped fixedly into the holes arranged in the fixing plates 22. A good fixing of the cover on the cushion, also in the middle of the surfaces, is thus obtained.

It will be apparent that the plates 23 have to be arranged on positions in the cover corresponding with the positions of the filling fixing plates 22.

To this end, in the case of a cushion with a high back as shown in FIG. 4, the plates 23 are fixed in accordance with the following dimensions: the distance between the two rows of plates amounts to 19 cm, while the two rows are each at a distance of 18.5 cm from the closest side edge. The distance between the top edge and the upper row of plates amounts to 27 cm, the same as between the upper and the lower row of plates of the back cushion, while the distance between the lower row of plates of the back cushion and the seam amounts to 28 cm. In the case of the seat portion the distance between the plates and the centre seam is 25 cm and between the plates and the front seam 26 cm.

In the case of a seat with a low back the same measurements apply except that on the back portion the distance between the plates and the top edge and the centre seam amounts to 28 cm.

The measurements of a cover for a tabouret cushion correspond with those of the cover for a low-backed cushion.

In the case of a cushion for a bed-seat the distance between the two rows of studs amounts to 25 cm, while the distance between each row of studs and the closest side edge is 22 cm. On the back portion the distance between the two upper studs and the top edge, between the two upper and two lower studs and between the two lower studs and the centre seam amounts to 28 cm.

The distance between the centre seam and the closest row of studs in the seat portion amounts to 33 cm, as does the distance between the front seam and the closest row of studs. The center row of studs lies 32 cm removed from the other studs.

The fixing of the plates will subsequently be described in more detail with reference to FIG. 5.

Figure 5:
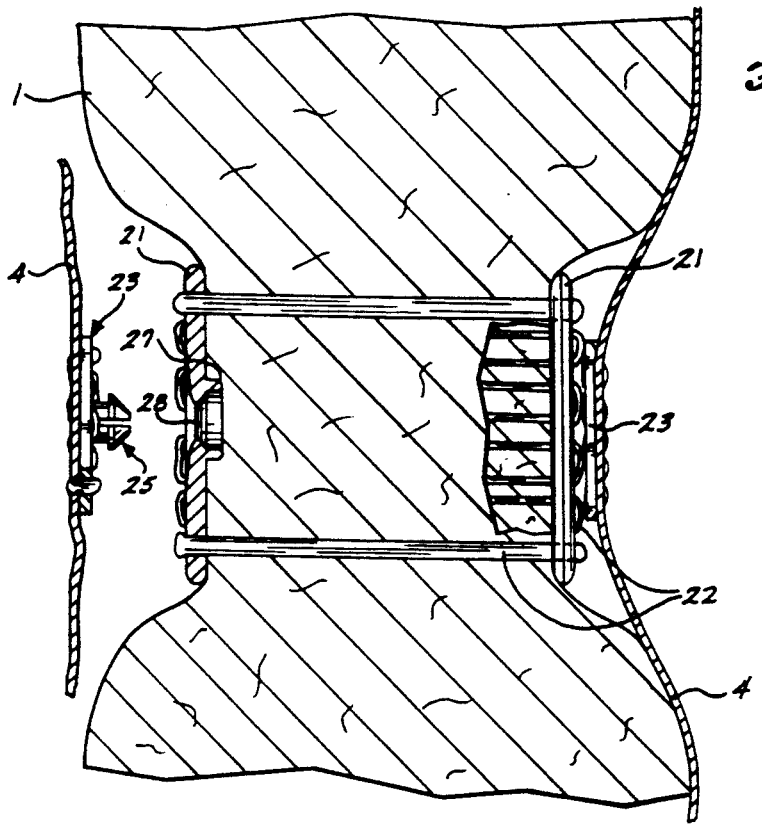
FIG. 5 shows a detail sectional view of a filling as according to the embodiment depicted in FIG. 4.

As shown in FIG. 5, both square filling fixing plates 21 are mutually connected through the filling 1 by means of a stitch connection 22. During fitting of these filling fixing plates the positioning thereof must be performed in accurate manner, since otherwise the holes in the filling fixing plates are not mutually aligned and the stitched seams 22 cannot be arranged mechanically. In order to facilitate positioning the plates take a square form. Each filling fixing plate is provided with sixteen holes which are disposed regularly in a circle. This step is also necessary to enable mechanical fitting of the filling fixing plates.

Figure 6:
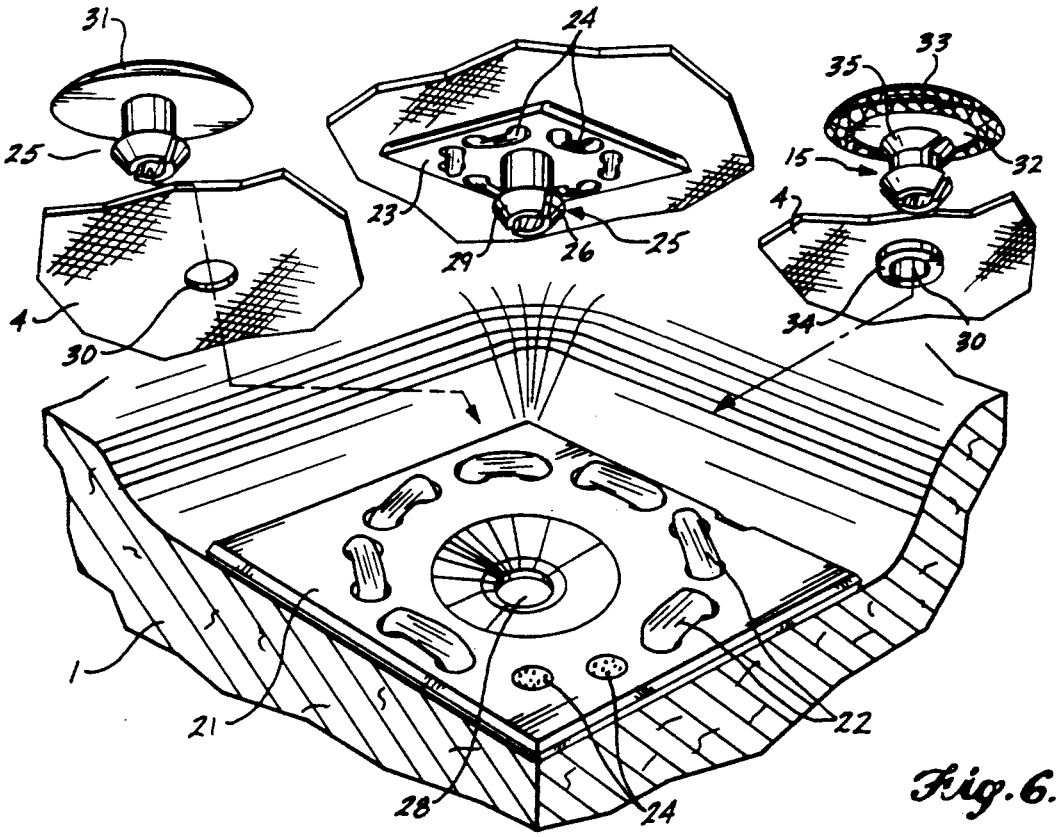
FIG. 6 shows a perspective detail sectional view of the connecting means according to alternative embodiments.

Arranged against the inside of the cover 4 are plates 23. As shown in FIG. 6, these plates 23 are also provided with openings 24 ordered in a circle. For attachment the plate 23 is provided with a mushroom-shaped protrusion 25 which is furnished with a saw-cut portion 26. The plate 21 further comprises a funnel-shaped edge 27 which adjoins a central opening 28 arranged in the plate 21. By pressing the cover 4 at the position of the plate 23 against the filling 1 at the position of the plate 21 the mushroom-shaped protrusion 25 will be guided into the funnel 27, wherein the mushroom-shaped protrusion 25 is pressed into the opening 28 until the thickened portion 29 arranged on the end of the mushroom-shaped protrusion is situated on the rear side of the plate 21. A snap connection is thus effected.

FIG. 6 also shows two other embodiments of the fastening of the cover. Arranged in the cover material 4 for this purpose is a hole 30 wherethrough a stud 31 provided with a mushroom-shaped protrusion 25 can be pressed so that the body of the stud is situated on the outside of the cover 4, while the protrusion 25 extends through the opening 30. A connection can also be achieved herein in the same way as with the plate 23.

In the case of the stud 32, which is provided with a fabric covering 33, the stud is fastened to the cover by means of a ring 34. The mushroom-shaped protrusion 25 is provided for this purpose with a second conical edge 35.

The mushroom-shaped protrusion 25 is placed through the opening 30 and the ring 34 pressed in place behind the second conical edge 35 so that the stud 32 is fastened to the cover 4. The stud 32 can then be "snapped" into the plate 21.

The present invention is not limited to cushions for garden furniture, but is also applicable to cushions for other purposes.

I claim:

1. A cushion filling defining an outer surface having a first side for supporting a person's weight and a second opposing side, the filling being capable of being enclosed on both the first and second sides by a cover provided with at least one opening for receiving and completely enclosing the filling, wherein:

the filling is provided on its outer surface with first connection elements that are releasably connectable with second connection elements provided on an inner surface of the cover, and wherein each of the first connection elements comprises a square plate that forms an outwardly extending funnel disposed around a central opening defined by the plate for receiving a second connection element of the cover, the plate further defining a plurality of openings disposed regularly in a circle about the central opening, the plate being secured to the filling by stitching thread extended through the filling and the circularly disposed openings.

2. A filling as claimed in claim 1, wherein plates are arranged on either side of the filling, being aligned relative to each other and extending through the circularly disposed openings of both plates.

* * * * *

UNITED STATES PATENT AND TRADEMARK OFFICE

CERTIFICATE OF CORRECTION

PATENT NO. : 5,302,001

DATED : April 12, 1994

INVENTOR(S) : W. van Dis

It is certified that error appears in the above-indentified patent and that said Letters Patent is hereby corrected as shown below:

| COLUMN | LINE | |
|---|---|---|
| 1 | 62 | after "As" insert --a-- |
| 2 | 17 | "embodiments;" should read --embodiments.-- and thereafter begin a new heading with --Detailed Description of the Preferred Embodiment-- |
| 2 | 27 | "designed" should read --designated-- |
| 4 | 2 | delete "moved" |
| 4 | 47 | "center" should read --centre-- |
| 6 (Claim 2, | 27 Line 3) | after "and" insert --the stitching thread-- |

Signed and Sealed this

Ninth Day of August, 1994

Bruce Lehman

*Attest:*

BRUCE LEHMAN

*Attesting Officer*

*Commissioner of Patents and Trademarks*